US010156375B2

(12) United States Patent
Oh

(10) Patent No.: US 10,156,375 B2
(45) Date of Patent: Dec. 18, 2018

(54) AIR EXHAUST APPARATUS

(71) Applicant: Hee Bum Oh, Gyeonggi-do (KR)

(72) Inventor: Hee Bum Oh, Gyeonggi-do (KR)

(73) Assignee: Hee Bum Oh, Gyeonggi-Do (KR)

( * ) Notice: Subject to any disclaimer, the term of this patent is extended or adjusted under 35 U.S.C. 154(b) by 113 days.

(21) Appl. No.: 15/069,157

(22) Filed: Mar. 14, 2016

(65) Prior Publication Data

US 2017/0261217 A1 Sep. 14, 2017

(51) Int. Cl.
*F24F 7/06* (2006.01)
*F24F 13/08* (2006.01)

(52) U.S. Cl.
CPC ..... *F24F 7/065* (2013.01); *F24F 13/082* (2013.01)

(58) Field of Classification Search
CPC ..... F24F 7/065; F24F 13/082
USPC ..... 454/344
See application file for complete search history.

(56) References Cited

U.S. PATENT DOCUMENTS

| | | | | |
|---|---|---|---|---|
| 3,201,032 | A * | 8/1965 | Gelbard | F04D 29/4253 415/217.1 |
| 3,403,614 | A | 10/1968 | Carnes | |
| 3,559,560 | A | 2/1971 | Trahan | |
| 4,020,752 | A | 5/1977 | Stephan | |
| 4,452,037 | A * | 6/1984 | Waddington | F01D 25/18 184/6.11 |
| D325,434 | S | 4/1992 | Dosmann et al. | |
| 5,747,883 | A * | 5/1998 | Hammer | F04D 25/02 123/41.49 |
| 5,807,171 | A | 9/1998 | Felsen | |
| 6,135,878 | A | 10/2000 | Felsen | |
| 6,935,571 | B2 | 8/2005 | Van Der Merwe | |
| D521,631 | S | 5/2006 | Habensus | |
| 7,645,188 | B1 | 1/2010 | Peerbolt | |
| 2005/0202776 | A1 * | 9/2005 | Avedon | F04D 25/088 454/230 |
| 2012/0202415 | A1 * | 8/2012 | Rudd | F24F 7/06 454/338 |

FOREIGN PATENT DOCUMENTS

| | | | | |
|---|---|---|---|---|
| KR | 100589607 | B1 | 6/2006 | |
| KR | 100684696 | B1 | 2/2007 | |
| KR | 101259586 | B1 * | 4/2013 | F04D 17/16 |
| KR | 101387016 | B1 | 4/2014 | |
| WO | 2008/114906 | A1 | 9/2008 | |

* cited by examiner

*Primary Examiner* — Steven B McAllister
*Assistant Examiner* — Allen Schult
(74) *Attorney, Agent, or Firm* — The PL Law Group, PLLC

(57) ABSTRACT

An air exhaust apparatus includes a housing, a shaft, a bearing part, a propeller, and an impeller disposed at a lower portion of the shaft. The housing has a space formed therein and an outlet formed at an upper portion thereof to discharge air flowed into the space. The shaft is installed inside of the housing in a vertical direction. The bearing part supports the shaft to revolve. The propeller is disposed at an upper portion of the shaft to be rotated by an exhaust suction flow in a duct. The impeller includes a rotating plate having a through hole for air inlet and a plurality of fins formed on the rotating plate, and is rotated with the propeller. A funnel-shaped vortex is formed under the impeller when the propeller and impeller revolve.

9 Claims, 4 Drawing Sheets

AIR EXHAUST APPARATUS

BACKGROUND

1. Field

Exemplary embodiments of the inventive concept relate to an air exhaust apparatus installed at a ceiling, wall or floor which is an end of a duct of centralized exhaust system. More particularly, exemplary embodiments of the inventive concept relate to an air exhaust apparatus capable of improving capture and exhaust performance. Exhaust airflow in the duct caused by a central exhaust blower may revolve a propeller which is connected to a shaft and a vortex impeller. Thus, the vortex impeller may revolve to make a vortex under the air exhaust apparatus. The air exhaust apparatus may efficiently capture and exhaust sources of air pollution due to the vortex.

2. Description of the Related Art

Generally, large structures such as an office building, a shopping mall, a manufacturing facility has an outdoor air supply blower and an air exhaust, and has an indoor duct for an indoor air ventilation. An air diffuser having a louver may be installed at a ceiling, wall or floor which is an end of the duct. The air diffuser is a device to provide clean air, and there are varieties of technologies and designs patents as described in FIG. 1. For example, U.S. Pat. No. D325,434 entitled "Air Diffuser", U.S. Pat. No. D521,631 entitled "Air Diffuser", U.S. Pat. No. 3,403,614 entitled "Environmental Enclosure With Ceiling Air Plenum", U.S. Pat. No. 3,559,560 entitled "Ceiling Boxes For Distributing Air", U.S. Pat. No. 4,020,752 entitled "Air Diffuser with Modular Core", U.S. Pat. No. 5,807,171 entitled "Air Diffuser Apparatus", U.S. Pat. No. 6,135,878 entitled "Modular Core Air Diffuser", U.S. Pat. No. 6,935,571 entitled "Air Diffuser", and U.S. Pat. No. 7,645,188 entitled "Air Diffuser Apparatus".

However, the air diffuser having a louver to distribute clean air evenly into indoor may also be used as an exhaust outlet for exhausting, the exhaust outlet may decrease inhale air flow velocity for collecting the sources of pollution, so that capture efficiency may be worse.

In addition, ventilation of a traditional exhaust outlet may be dependent on air flow. Polluted air from indoor may flow out and clean air from outside may flow in for the ventilation to decrease the concentration of indoor air pollution. Thus, ventilation rates or air change rates may be determined according to indoor condition, then supply and exhaust air flow may be calculated to fit the ventilation.

However, the excessive ventilation rate which is needed to clean may cause energy waste issue, because the sources of pollution which is far from the exhaust outlet or air diffuser may be hard to be carried out. This is simply not the only electrical cost of operating a ventilation system, resulting in the waste of energy due to excessively discharging room air containing heating and cooling energy.

Main cause of these problems is that a certain degree of capture velocity is needed to carry the sources of pollution with exhaust air.

Capture velocity is defined as an air velocity at any point in front of the exhaust outlet necessary to overcome opposing air currents and to capture the contaminant at that point causing it to flow into the exhaust.

However, the capture velocity is rapidly decreased in inversely proportional to square of the distance far from the exhaust outlet. Generally, the capture velocity may be lower than 10% of exhaust face velocity (flow rate at surface of the exhaust outlet) where is far from the exhaust outlet by a diameter of the exhaust outlet.

Because of these reasons, a traditional ventilation system has a problem with low capture efficiency and wasting of energy.

SUMMARY

One or more exemplary embodiment of the inventive concept provides an air exhaust apparatus which works by exhaust suction flow in a traditional duct capable of solving above problems.

The air exhaust apparatus may be installed at a ceiling, wall or floor which is an end of the duct of buildings.

Accordingly, when a blower of a central exhaust device is driven, exhaust suction flow may be formed in the duct, and then the exhaust suction flow may rotate a propeller. The propeller may be connected to a shaft. The propeller may revolve with an impeller which is connected the shaft. Here, fins of the impeller push air outward, and then the pushed air flows along a direction which is in parallel with a rotating plate and loses momentum, and then the air which lost momentum may return to the impeller by an inhale air flow caused by a suction force in the duct. Thus, a funnel-shaped vortex may be formed under the air exhaust apparatus.

Strong low pressure area may be formed in the vortex. High pressure air around the vortex may flow into the low pressure area in the vortex with high speed, so that capture velocity may be increased.

Therefore, the sources of pollution indoor may be effectively captured and exhausted, so that the improvement of indoor air quality may be accomplished without additional electricity.

In addition, the air exhaust apparatus has a same shape and size as the traditional air diffuser, so that the air exhaust apparatus may be easily installed or replaced without additional electrical work for a new building as well as for an old building.

According to the exemplary embodiments of the present inventive concept, an air exhaust apparatus includes a housing, a shaft, a bearing part, a propeller, and an impeller. The housing has a space formed therein and an outlet formed at an upper portion thereof to discharge air flowed into the space. The shaft is installed inside of the housing in a vertical direction. The bearing part supports the shaft to revolve. The impeller is disposed at a lower portion of the shaft. The impeller includes a rotating plate having a through hole for air inlet and a plurality of fins formed on the rotating plate. The impeller is rotated with the propeller. A funnel-shaped vortex is formed under the impeller when the propeller and impeller revolve. Thus, the air exhaust apparatus using exhaust suction flow may improve capture efficiency.

In addition, the air exhaust apparatus may further include a protecting cover having a plurality holes disposed under the impeller to protect the impeller.

In addition, the air exhaust apparatus may further include a gear part to increase or decrease revolution of the impeller from revolution of the propeller. The gear part may be installed at the shaft.

In addition, the propeller may be formed by lightweight material to maximize revolution speed, and may have an airfoil shape to get lift force or drag force.

The impeller may include a rotating plate having a ring shape, a plurality of connecting rods arranged along inner surface of the rotating plate, a plurality of fins formed on the rotating plate, and a circular belt formed between the connecting rod and the inner surface of the rotating plate and having uniform height. The rotating plate may revolve integrally with the shaft. The connecting rods may be combined with the shaft.

When the impeller revolves, the fins push air outward, and then the pushed air flows along a direction which is in parallel with the rotating plate and loses momentum, and then the air which lost momentum may return to the impeller by an inhale air flow caused by a suction force in the duct. Thus, a funnel-shaped vortex may be formed under the impeller.

Strong low pressure area may be formed in the vortex. High pressure air around the vortex may flow into the low pressure area with high speed through a through hole formed at inner side of the rotating plate, and then the air may be exhausted.

Here, a portion of the air which is flowed into the through hole may not be exhausted but be re-defused by the fins which push the air outward. The circular belt, which is formed between the connecting rod and the inner surface of the rotating plate and has uniform height, may block the air from being re-defused. So that exhaust performance may be improved.

When the impeller is formed by a plastic injection, the rotating plate, the fins, the circular belt and the connecting rods may be integrally formed.

According to the exemplary embodiments of the present inventive concept, the air exhaust apparatus may further include a bell mouth disposed outer side of the impeller and spaced apart from the impeller.

The bell mouth may receive the impeller, and guide air flow using coanda effect that fluid flows along adjacent surfaces to enlarge the vortex. The bell mouth may have an obtuse angle with reference to a bottom surface, and may have variety shapes such as a quadrangle, circle and etc.

According to the exemplary embodiments of the present inventive concept, the air exhaust apparatus may work by exhaust suction flow in a duct of a central exhaust system. The propeller and the impeller may revolve by the exhaust suction flow in the duct, so that funnel-shaped vortex may be formed thereunder. Pressure difference in the vortex may increase capture velocity, so that sources of pollution may be effectively removed. Thus, capture efficiency may be increased.

In addition, air ventilation may be performed without additional electricity according to the present invention, so that it has the effect of reducing the noise and energy saving. The air exhaust apparatus according to the present invention may replace the air diffuser of old buildings to improve indoor air quality.

BRIEF DESCRIPTION OF THE DRAWINGS

The above and other features of the inventive concept will become more apparent by describing in detail exemplary embodiments thereof with reference to the accompanying drawings, in which.

DETAILED DESCRIPTION

Figure 1:
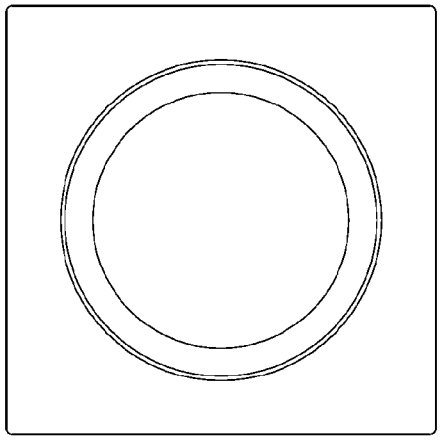
FIG. 1 is a bottom view illustrating an air diffuser according to the prior art.
Figure 2:
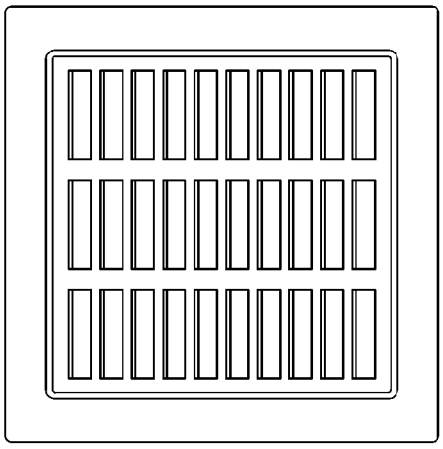
FIG. 2 is a bottom view illustrating another air diffuser according to the prior art.

According to present example embodiment, an air exhaust apparatus may work by exhaust suction flow in a duct. The air exhaust apparatus may include a space form inside thereof, a housing which has an outlet formed on the upper side of the air exhaust apparatus, a shaft vertically installed inside the housing, a bearing part supporting the shaft to revolve, a propeller disposed at an upper portion of the shaft, and an impeller. Air flowed in the space may flow out through the outlet. The propeller may be revolved by the exhaust suction flow. The impeller may be combined to a lower portion of the shaft to be rotated with the propeller. The impeller may include a rotating plate having a through hole for air inlet and a plurality of fins formed on the rotating plate. When the propeller and the impeller rotate, funnel-shaped vortex may be formed outside of the air exhaust apparatus under the impeller.

In addition, the air exhaust apparatus may further include a protecting cover disposed under the impeller and having a plurality of holes to protect the impeller.

In addition, the air exhaust apparatus may further include a gear part to increase or decrease revolutions of the impeller according to revolution of the propeller. The gear part may be installed at the shaft.

In addition, the propeller may be formed by lightweight material to maximize revolution speed, and may have an airfoil shape to get lift force or drag force.

In addition, the impeller may include a rotating plate which revolves with respect to the shaft, a plurality of connecting rods which are arranged along an inner surface of the rotating plate, a plurality of fins which are formed on the rotating plate and have predetermined inclined angle, and a circular belt which is formed between the inner surface of the rotating plate 83 and the connecting rods 81, has a uniform height in the vertical direction, and has a circular belt shape.

In addition, when the impeller is driven, a vortex may be formed thereunder by the impeller and the fins, and then air flowed into the vortex and a through hole between the connecting rods due to pressure difference and air flow formed by cyclone of the vortex, and then a portion of the air is blocked by the circular belt, so that the air is not re-defused by the fins but is exhausted through the through hole.

In addition, the impeller may further include a flap at the connecting rod to increase inhale flow rate.

In addition, the connecting rod may have a flap shape which is inclined.

In addition, the air exhaust apparatus may further include a bell mouth which is formed spaced apart from the impeller in outer direction.

In addition, the impeller may include a rotating plate through which a shaft is formed, a plurality of connecting rods, a circular belt and a plurality of fins. The connecting rods may be formed along a boundary of the rotating plate in a radial direction. The circular belt may be formed along a boundary of the connecting rods. The fins may be formed on an outer surface of the circular belt, and extend in a radial direction.

The present invention is described more fully hereinafter with reference to the accompanying drawings, in which example embodiments of the present invention are shown. The present invention may, however, be embodied in many different forms and should not be construed as limited to the example embodiments set forth herein. Rather, these example embodiments are provided so that this disclosure will be thorough and complete, and will fully convey the scope of the present invention to those skilled in the art.

Figure 3:
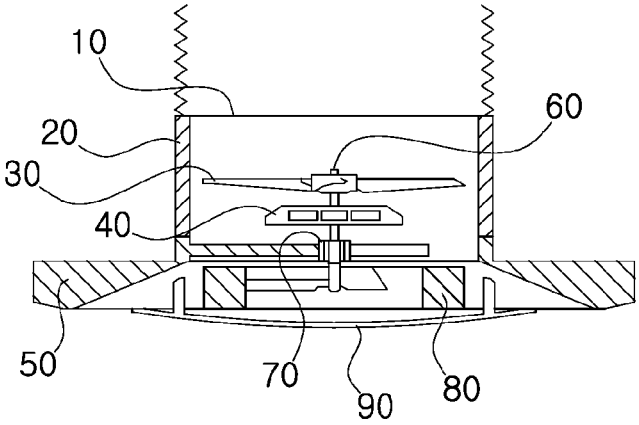
FIG. 3 is a cross-sectional view illustrating an air exhaust apparatus according to an exemplary embodiment of the inventive concept.
Figure 4:
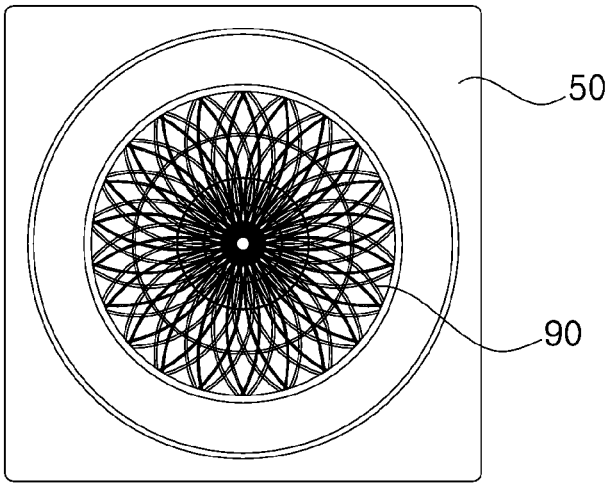
FIG. 4 is a bottom view illustrating the air exhaust apparatus of FIG. 3.
Figure 5:
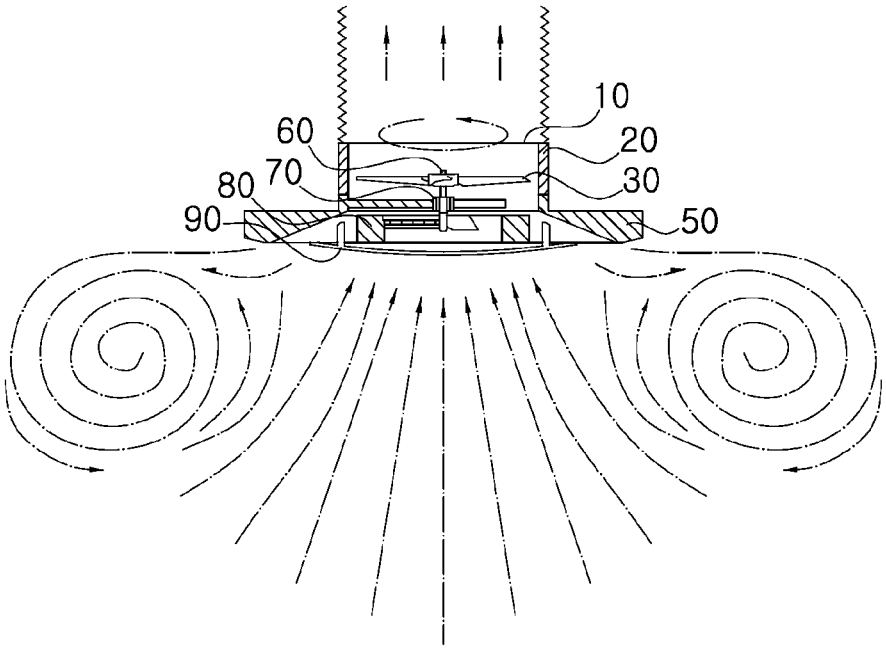
FIG. 5 is a cross-sectional view to explain a performance property of the air exhaust apparatus of FIG. 3.

FIG. 3 is a cross-sectional view illustrating an air exhaust apparatus according to an exemplary embodiment of the inventive concept. FIG. 4 is a bottom view illustrating the air exhaust apparatus of FIG. 3. FIG. 5 is a cross-sectional view to explain a performance property of the air exhaust apparatus of FIG. 3.

Referring to FIGS. 3 and 5, the air exhaust apparatus may work by exhaust suction flow in a duct of a central exhaust system. The air exhaust apparatus may include a housing 20, a propeller 30, impeller 80, shaft 60, bearing part 70, bell mouth 50 and a protecting cover 90.

A space may be formed inside of the housing 20. The shaft 60 is installed in the space, vertically. The propeller 30 may be disposed at an upper portion of the shaft 60.

Figure 9:
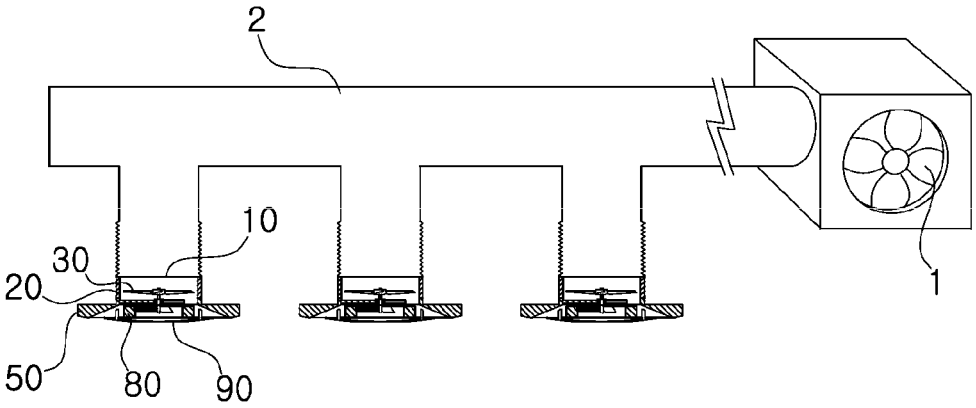
FIG. 9 is a schematic diagram illustrating a central exhaust system according to an exemplary embodiment of the inventive concept.

The outlet 10 may be formed at an upper portion of the housing 20. Air flowed into the space may flow out through the outlet 10. The outlet 10 may be connected to a blower (refers to 1 of FIG. 9) of the central exhaust system through the duct. Air flowed into the housing 20 may be flow out through the outlet 10, the duct and the blower 1.

Figure 8:
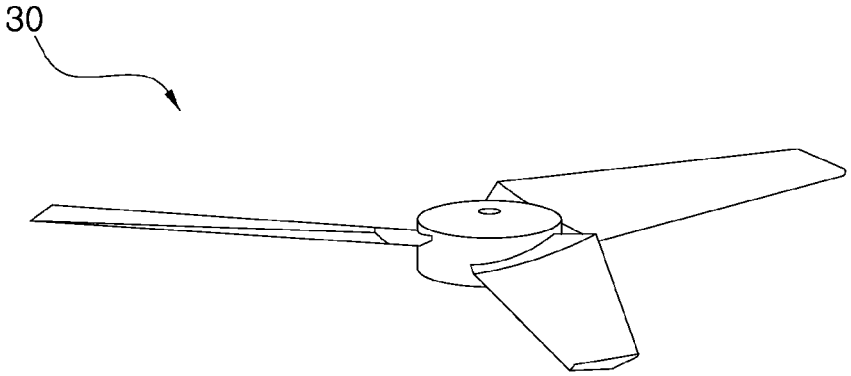
FIG. 8 is a perspective view illustrating a propeller of the air exhaust apparatus of FIG. 3.

The propeller 30 may rotate by exhaust suction flow in the duct caused by working of the blower. An example embodiment of the propeller 30 is described in FIG. 8.

The shaft 60 may penetrate the propeller 30. The propeller 30 may be integrally revolved with the impeller 80 due to the shaft 60.

Thus, the propeller 30 may be provided at the upper portion of the shaft 60 which is vertically installed in the middle of the housing 20, and the impeller 80 may be provided at the lower portion of the shaft 60, so that propeller 30 and impeller 80 may be revolve at the same time.

Here, the bearing part 70 may be formed on an outer surface of the shaft 60 under the propeller 30 to support the propeller 30. The shaft 60 may penetrate a bottom surface of the housing 20.

The air exhaust apparatus may further include a gear part 40 to increase or decrease revolutions of the impeller 80 between the propeller 30 and the impeller 80 through the shaft 60.

Figure 6:
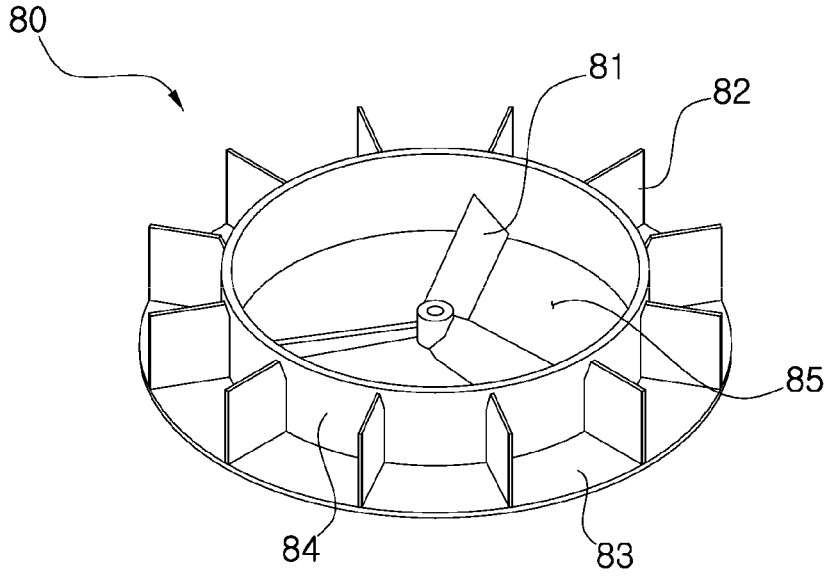
FIG. 6 is a perspective view illustrating an impeller of the air exhaust apparatus of FIG. 3.

An example embodiment of the impeller 80 is described in FIG. 6. The impeller 80 may include a rotating plate 83, a plurality of connecting rods 81, a plurality of fins 82, and a circular belt 84. A through hole 85 may be formed at the middle of the rotating plate 83. The connecting rods 81 may be arranged along an inner surface of the rotating plate 83 and spaced apart from each other. The fins 82 may be formed on the rotating plate 83 spaced apart form each other and in a radial direction. The fin 82 may extend in a vertical direction. The circular belt 84 may be formed between the inner surface of the rotating plate 83 and the connecting rods 81, may have a uniform height in the vertical direction, and may have a circular belt shape. The connecting rods 81 may be formed along a boundary of an axis portion in the radial direction. The shaft 60 may be combined with the axis portion.

Here, air with sources of air pollution flowed into the air exhaust apparatus through the through hole 85 due to pressure difference may flow toward the fins 82, and be blocked by the inner surface of the circular belt 84, so that the air may flow into the housing 20 through the through hole 85 formed between the connecting rods 81.

Figure 7:
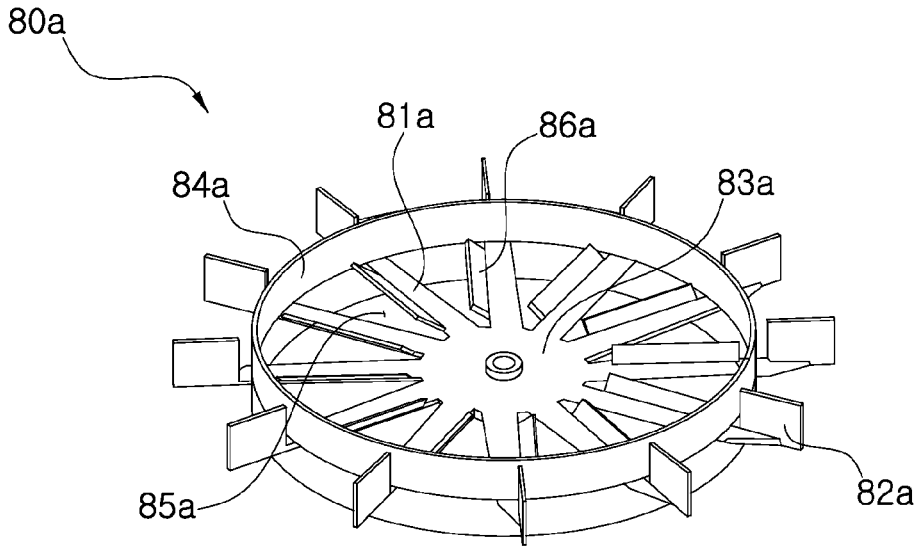
FIG. 7 is a perspective view illustrating an impeller of an air exhaust apparatus according to another exemplary embodiment of the inventive concept.

In addition, another example embodiment of the impeller 80*a* is described in FIG. 7. The impeller 80*a* may include a rotating plate 83*a* through which the shaft 60 is formed, a plurality of connecting rods 81*a*, a circular belt 84*a* and a plurality of fins 82*a*. The connecting rods 81 may be formed along a boundary of the rotating plate 83*a* in the radial direction. The circular belt 84*a* may be formed along a boundary of the connecting rods 81. The fins 82*a* may be formed on an outer surface of the circular belt 84*a*, extend in a radial direction, and be spaced apart form each other along a boundary of the circular belt 84*a*.

When the impeller 80*a* revolves, the fins 82*a* push air to out of the impeller 80*a*, and then the pushed air flows along a direction which is in parallel with the rotating plate 83*a* and loses momentum. Here, the air which lost momentum may be re-entered into the through hole 85*a* between the connecting rods 81*a* by an inhale air flow caused by a suction force in the duct 2. Thus, a funnel-shaped vortex may be formed under the air exhaust apparatus.

A strong cyclone may be formed in the vortex, and then a high pressure air may be filled into the strong cyclone rapidly. Therefore, air with sources of pollution may be discharged through the through hole 85*a* of the rotating plate 83*a* and the outlet 10.

Here, the connecting rods 81 of the impeller 80 may have a flap which is tilted at a predetermined angel to discharge rapidly the sources of pollution.

In addition, as described in FIG. 7, the connecting rods 81*a* of the impeller 80*a* may have a flap 86*a* which is formed thereon and tilted at a predetermined angel.

Here, the flap of the connecting rods 81 of FIG. 6 or the flap 86*a* of FIG. 7 may be formed with an acute angle inclined in a rotating direction of the impeller 80 or 80*a*, and increase rotation of the impeller 80 and 80*a* by a drag force of the inhale air flow. In addition, the flap of the connecting rods 81 or the flap 86*a* may increase inhale air flow velocity through the through hole 85.

The Bell mouth 50 may be spaced apart from the impeller 80 in an outer direction as described in FIG. 3. Thus, the impeller 80 may be received in the Bell mouth 50. In addition, an inner surface of the Bell mouth 50 may be inclined with an obtuse angel with respect to a bottom surface.

The Bell mouth 50 may protect the impeller 80 from exposure of impeller 80 outside of the air exhaust apparatus, and may guide air pushed by the impeller 80, so that inner diameter of the funnel-shaped vortex formed under the air exhaust apparatus may be enlarged to increase capture range of the sources of pollution.

Here, the protecting cover 90 may be disposed under the impeller 80 and be supported by the bell mouth 50. The protecting cover 90 may have a grill type, and may prevent users from injury.

According to present example embodiment, an air exhaust apparatus may work by exhaust suction flow in a duct of a central exhaust system. The air exhaust apparatus may be installed at a ceiling, wall or floor which is an end of a duct 2 which is connected to a blower 1 of a building as described in FIG. 9. The air exhaust apparatus may be driven without any additional power source except an exhaust suction flow formed in the duct 2 by driving of the blower 1.

According to present example embodiment, an air exhaust apparatus may work by exhaust suction flow in a duct of a central exhaust system. When the blower 1 of a building central exhaust device is driven, exhaust suction flow may be formed, and then the exhaust suction flow may rotate a propeller 30.

Here, the propeller 30 may be connected to a shaft 60. The propeller 30 may revolve with an impeller 80 which is connected the shaft 60.

When the impeller 80 revolves, fins 82 pushes air outward, and then the pushed air flows along a direction which is in parallel with a rotating plate 83 and loses momentum, and then the air which lost momentum may return to the impeller 80 by an inhale air flow caused by a suction force in the duct. Thus, a funnel-shaped vortex may be formed under the air exhaust apparatus.

Thus, according to the air exhaust apparatus of the present example, air with sources of pollution may flow into a housing 20 and be discharged through an outlet 10 due to a pressure difference and airflow formed by the vortex.

Here, a circular belt 84 formed at inner side of the rotating plate 83 may prevent re-diffusion of the polluted air.

The foregoing is illustrative of the inventive concept and is not to be construed as limiting thereof. Although a few exemplary embodiments of the inventive concept have been described, those skilled in the art will readily appreciate that many modifications are possible in the exemplary embodiments without materially departing from the novel teachings and advantages of the inventive concept. Accordingly, all such modifications are intended to be included within the scope of the inventive concept as defined in the claims. In the claims, means-plus-function clauses are intended to cover the structures described herein as performing the recited function and not only structural equivalents but also equivalent structures. Therefore, it is to be understood that the foregoing is illustrative of the inventive concept and is not to be construed as limited to the specific exemplary embodiments disclosed, and that modifications to the disclosed exemplary embodiments, as well as other exemplary embodiments, are intended to be included within the scope of the appended claims. The inventive concept is defined by the following claims, with equivalents of the claims to be included therein.

What is claimed is:

1. An air exhaust apparatus, comprising:

a housing having a space formed therein and an outlet formed at an upper portion thereof to discharge air flowed into the space;

a shaft installed inside of the housing in a vertical direction;

a bearing part supporting the shaft to revolve;

a propeller disposed at an upper portion of the shaft to be rotated only by an exhaust suction flow in a duct of a central exhaust system, and having an airfoil shape to maximize revolution speed;

an impeller disposed at a lower portion of the shaft, and comprising a rotating plate having a through hole for air inlet and a plurality of fins formed on the rotating plate, the impeller being rotated with the propeller, and a bell mouth disposed outer side of the impeller and spaced apart from the impeller, wherein a funnel-shaped vortex is formed under the impeller when the propeller and impeller revolve, and the impeller is positioned within the bell mouth so that an air flow is guided by Coanda effect to enlarge the vortex.

2. The air exhaust apparatus of claim 1, further comprising a protecting cover having a plurality holes disposed under the impeller to protect the impeller.

3. The air exhaust apparatus of claim 1, further comprising a gear part to increase or decrease revolution of the impeller from revolution of the propeller, the gear part being installed at the shaft.

4. The air exhaust apparatus of claim 1, wherein the impeller comprises a rotating plate having a ring shape, a plurality of connecting rods arranged along an inner surface of the rotating plate, a plurality of fins formed on the rotating plate, and a circular belt formed between the connecting rods and the inner surface of the rotating plate and having uniform height, and the connecting rods are combined with the shaft, and spaced apart from each other.

5. The air exhaust apparatus of claim 1, wherein the impeller comprises a rotating plate combined with the shaft, a plurality of connecting rods arranged along the boundary of the rotating plate, a circular belt formed along boundaries of the connecting rods and a plurality of fins formed on an outer surface of the circular belt, and the connecting rods extends in a radial direction, and each of the fins extends in a radial direction.

6. The air exhaust apparatus of claim 4, wherein the connecting rods are tilted at a predetermined angle.

7. The air exhaust apparatus of claim 5, wherein the connecting rods of the impeller further comprise a flap which is formed on the connecting rods and inclined in a rotating direction of the impeller with an acute angle to increase inhale airflow velocity.

8. The air exhaust apparatus of claim 1, wherein a bottom surface of the impeller does not protrude out of a bottom line of the bell mouth.

9. The air exhaust apparatus of claim 1, wherein an inside of the bell mouth has an obtuse angle with reference to a bottom surface of the bell mouth.

* * * * *